US007086531B2

(12) United States Patent
Apps et al.

(10) Patent No.: US 7,086,531 B2
(45) Date of Patent: Aug. 8, 2006

(54) STACKABLE LOW DEPTH BOTTLE CASE

(75) Inventors: William P. Apps, Alpharetta, GA (US); Gerald R. Koefelda, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 16 days.

(21) Appl. No.: 09/844,822

(22) Filed: Apr. 26, 2001

(65) Prior Publication Data

US 2001/0015329 A1 Aug. 23, 2001

Related U.S. Application Data

(63) Continuation of application No. 08/854,294, filed on May 12, 1997, now abandoned, which is a continuation of application No. 08/480,927, filed on Jun. 7, 1995, now abandoned, which is a continuation-in-part of application No. 08/421,941, filed on Apr. 13, 1995, now Pat. No. 5,651,461, which is a continuation-in-part of application No. 08/384,331, filed on Feb. 1, 1995, now Pat. No. 5,660,279, and a continuation-in-part of application No. 08/268,997, filed on Jun. 30, 1994, now Pat. No. 5,465,843, which is a continuation-in-part of application No. 29/018,317, filed on Feb. 3, 1994, now Pat. No. Des. 361,431, which is a continuation-in-part of application No. 07/919,376, filed on Jul. 29, 1992, now Pat. No. 5,529,176.

(51) Int. Cl.
*B65D 21/32* (2006.01)

(52) U.S. Cl. ..... 206/509

(58) Field of Classification Search ..... 220/506, 220/516, 517, 518, 519; 206/139, 201, 203, 206/427, 509, 511

See application file for complete search history.

(56) References Cited

U.S. PATENT DOCUMENTS

| | | | |
|---|---|---|---|
| 1,112,943 | A | 10/1914 | Stone |
| 2,064,518 | A | 12/1936 | Brogden |
| 2,411,673 | A | 11/1946 | Vechey, Jr. |
| D147,981 | S | 11/1947 | Lehman |
| 2,530,481 | A | 11/1950 | Rawn, Jr. |
| 2,535,493 | A | 12/1950 | Gerber |
| 2,588,805 | A | 3/1952 | Cross |

(Continued)

FOREIGN PATENT DOCUMENTS

| | | |
|---|---|---|
| AU | 247904 | 8/1962 |

(Continued)

OTHER PUBLICATIONS

Product Brochure "Schoellerkasten" of Schoeller & Co. KG.

(Continued)

*Primary Examiner*—Stephen Castellano

(57) ABSTRACT

A stackable case for retaining and transporting bottles including outer side walls forming an outer shell having a longitudinal axis and a horizontal axis, a case bottom disposed substantially within the outer shell, and a plurality of supports for supporting the outer surfaces of the bottles. The side walls include a lower wall portion and a plurality of spaced upwardly projecting pylons, where four corner pylons define the four corners of the case. A plurality of spaced upwardly projecting columns generally disposed within the outer shell define, in combination with the case bottom, the side walls and the end walls, a plurality of bottle retaining pockets. The columns and the pylons extend above the lower wall portions and below a top surface of the retained bottles. At least one of the side walls includes an integrally molded logo which identifies the source of the goods.

47 Claims, 6 Drawing Sheets

U.S. PATENT DOCUMENTS

| | | | | |
|---|---|---|---|---|
| 2,626,079 | A | | 1/1953 | Keller |
| 2,743,030 | A | | 4/1956 | Read, Jr. |
| 2,760,676 | A | | 8/1956 | Knieriem et al. |
| 2,840,256 | A | | 6/1958 | Cobb, Jr. |
| 2,928,530 | A | | 3/1960 | Sauey |
| 2,935,222 | A | | 5/1960 | O'Connell |
| 2,970,715 | A | | 2/1961 | Kappel et al. |
| 2,974,819 | A | | 3/1961 | Melville |
| 2,979,222 | A | | 4/1961 | Levine |
| 3,009,579 | A | | 11/1961 | Ettlinger, Jr. |
| 3,055,542 | A | | 9/1962 | Russo |
| 3,092,284 | A | | 6/1963 | Stout |
| D195,702 | S | | 7/1963 | Russo |
| 3,148,797 | A | | 9/1964 | Cloyd |
| 3,151,762 | A | | 10/1964 | Vidal |
| 3,155,268 | A | | 11/1964 | Fogerty et al. |
| 3,184,148 | A | | 5/1965 | Poupitch |
| D201,257 | S | | 6/1965 | Vidal |
| 3,247,996 | A | | 4/1966 | Garcia |
| 3,283,947 | A | | 11/1966 | Cornelius |
| 3,297,190 | A | | 1/1967 | Cloyd |
| 3,326,410 | A | | 6/1967 | Asenbauer |
| 3,332,574 | A | | 7/1967 | Earp |
| 3,333,727 | A | | 8/1967 | Belcher et al. |
| 3,333,729 | A | | 8/1967 | Rabb |
| 3,334,767 | A | | 8/1967 | Cornelius et al. |
| 3,349,943 | A | | 10/1967 | Box |
| 3,376,998 | A | | 4/1968 | Cornelius |
| 3,379,339 | A | | 4/1968 | Asenbauer |
| 3,384,261 | A | | 5/1968 | Austin |
| 3,390,801 | A | | 7/1968 | Adomat |
| 3,391,814 | A | | 7/1968 | Box |
| 3,391,815 | A | | 7/1968 | Box |
| 3,392,869 | A | | 7/1968 | Needt |
| 3,416,694 | A | | 12/1968 | Bebb |
| 3,447,715 | A | | 6/1969 | Beney |
| 3,517,852 | A | | 6/1970 | Schoeller |
| 3,547,309 | A | | 12/1970 | Pusey et al. |
| 3,638,824 | A | | 2/1972 | Sekiguchi et al. |
| 3,651,976 | A | | 3/1972 | Chadbourne |
| 3,701,449 | A | | 10/1972 | Schoeller |
| 3,734,341 | A | | 5/1973 | Levenhagen |
| 3,759,416 | A | | 9/1973 | Constantine |
| 3,802,592 | A | | 4/1974 | Wheaton, III |
| 3,812,996 | A | | 5/1974 | Bunnell |
| 3,865,239 | A | | 2/1975 | Herolzer et al. |
| 3,949,876 | A | | 4/1976 | Bridges et al. |
| 4,027,796 | A | | 6/1977 | Martin |
| 4,037,722 | A | | 7/1977 | Bremer |
| 4,040,517 | A | | 8/1977 | Torokvei |
| 4,071,162 | A | | 1/1978 | Steinlein et al. |
| 4,095,720 | A | | 6/1978 | Delbrouck et al. |
| 4,101,049 | A | * | 7/1978 | Wallace et al. ..... 206/521.1 |
| 4,105,117 | A | | 8/1978 | Atkin et al. |
| 4,120,444 | A | | 10/1978 | Gray |
| 4,161,259 | A | | 7/1979 | Palafox |
| 4,162,738 | A | | 7/1979 | Wright |
| D255,097 | S | | 5/1980 | Carroll et al. |
| 4,202,448 | A | | 5/1980 | Jaeger et al. |
| 4,204,596 | A | | 5/1980 | Davis |
| 4,210,265 | A | | 7/1980 | Steinlein |
| 4,295,576 | A | | 10/1981 | Steinlein |
| 4,319,685 | A | | 3/1982 | David |
| 4,344,530 | A | | 8/1982 | deLarosiere |
| 4,349,121 | A | | 9/1982 | Lafferty |
| D266,709 | S | | 10/1982 | Box |
| 4,410,099 | A | | 10/1983 | deLarosiere |
| 4,416,373 | A | | 11/1983 | deLarosiere |
| 4,520,941 | A | | 6/1985 | Hagan et al. |
| 4,548,320 | A | | 10/1985 | Box |
| D284,841 | S | | 7/1986 | Rowland et al. |
| D285,851 | S | | 9/1986 | Rehrig |
| 4,619,371 | A | | 10/1986 | Rehrig |
| D289,938 | S | | 5/1987 | Warwick |
| 4,671,411 | A | | 6/1987 | Rehrig et al. |
| D291,178 | S | | 8/1987 | Toms |
| 4,700,836 | A | | 10/1987 | Hammett |
| 4,700,837 | A | | 10/1987 | Hammett |
| 4,759,451 | A | | 7/1988 | Apps |
| 4,773,554 | A | | 9/1988 | Warwick |
| 4,789,063 | A | | 12/1988 | Hammett |
| 4,823,955 | A | | 4/1989 | Apps |
| 4,848,580 | A | | 7/1989 | Wise |
| D304,123 | S | | 10/1989 | Warwick |
| 4,899,874 | A | | 2/1990 | Apps et al. |
| 4,932,532 | A | | 6/1990 | Apps et al. |
| 4,978,002 | A | | 12/1990 | Apps et al. |
| D313,493 | S | | 1/1991 | Apps et al. |
| D317,670 | S | | 6/1991 | Apps |
| D318,552 | S | | 7/1991 | Apps |
| 5,031,774 | A | | 7/1991 | Morris et al. |
| D319,129 | S | | 8/1991 | Apps et al. |
| D320,298 | S | | 9/1991 | Apps et al. |
| 5,060,819 | A | | 10/1991 | Apps |
| 5,071,026 | A | | 12/1991 | Apps |
| D325,279 | S | | 4/1992 | Apps |
| D326,749 | S | | 6/1992 | Apps et al. |
| D327,357 | S | | 6/1992 | Rehrig |
| D327,972 | S | | 7/1992 | Apps et al. |
| D329,931 | S | | 9/1992 | Apps |
| D329,932 | S | | 9/1992 | Apps |
| 5,184,748 | A | | 2/1993 | Apps |
| 5,335,814 | A | | 8/1994 | Hepp |
| 5,421,477 | A | | 6/1995 | Hammett |
| D360,758 | S | | 8/1995 | Umiker |
| D371,239 | S | | 7/1996 | Kelly |
| D378,249 | S | * | 3/1997 | Apps et al. ..... D3/310 |

FOREIGN PATENT DOCUMENTS

| | | |
|---|---|---|
| BE | 680197 | 10/1966 |
| BE | 693216 | 7/1967 |
| CA | 965056 | 3/1975 |
| CA | 1109433 | 9/1981 |
| DE | 1207268 | 12/1965 |
| DE | 1486412 | 5/1969 |
| EP | 99827 | 2/1984 |
| EP | 0 253 363 B1 | 5/1990 |
| FR | 1285689 | 1/1962 |
| FR | 1351218 | 12/1963 |
| FR | 1518610 | 2/1968 |
| FR | 2401087 | 3/1979 |
| GB | 943947 | 12/1963 |
| GB | 1032916 | 6/1966 |
| GB | 1115343 | 5/1968 |
| GB | 1120067 | 7/1968 |
| GB | 1152038 | 5/1969 |
| GB | 1312701 | 4/1973 |
| GB | 1319726 | 6/1973 |
| GB | 1330778 | 9/1973 |
| GB | 2079256 | 1/1982 |
| GB | 2135278 | 8/1984 |
| GB | 2158044 | 11/1985 |
| NL | 6505562 | 10/1966 |
| WO | WO 82/01536 | 5/1982 |
| WO | WO 92/15758 | 12/1990 |

OTHER PUBLICATIONS

Exhibit 1: Two photos of a prior art case of Rehrig Pacific fo 3 liter PET bottles.
Exhibit 2: Two photos of a prior art case of D & W Plastics.
Exhibit 3: Two photos of a prior art case of ICS for 3 liter PET bottles.

Exhibit 4: Two photos of a prior art case of ICS for 2 liter PET bottles.
Exhibits A & B: Two photos of an embodiment of U.S. Pat. No. 4,773,554 to Warwick.
Exhibits D-F: Three photos of a bottle neck resting type crate with projections above the outer side walls.
Exhibits G-J: Four photos of a bottle neck resting type crate without projections above the outer side walls.
Exhibit K: One photo of a bottle neck resting type with different height outer side walls.
Exhibit L: Four photos of an embodiment of Great Britain Patent Publication No. 2,158,044 & U.S. Design Patent No. D289,938.
Exhibit M: Copy of a brochure illustrating an embodiment of GB No. 2,158,044/U.S. D289,938.
Exhibit N: Copy of a brochure illustrating an embodiment of U.S. Patent No. 4,773,554 & an embodiment of GB No. 2,158,044/U.S. D289,938.
Exhibit O: Four photos of an embodiment of U.S. Patent No. 4,344,530 to deLarosiere.
Exhibit P: Two photos of an embodiment of U.S. Patent No. 4,700,837 to Hammett.
Exhibit Q: Four photos of an embodiment of U.S. Patent No. 4,344,530 for 3-liter PET bottles.
Exhibit R: Four photos of a modified embodiment of U.S. Patent No. 4,700,837 for 3-liter PET bottles.
Exhibit S: Three photos of an embodiment of U.S. Patent No. 3,392,869 to Needt.
Exhibit T: Four photos of a prior art crate of Rehrig-Pacific Company, Model No. PLBC-8-2L-HD.
Exhibit U: Four photos of a prior art crate of Rehrig-Pacific Company Model No. PLBC-6-2L-HD.
Exhibit V: Four photos of a prior art crate of Rehrig-Pacific Company, Model No. PLBC-8-2L-PET-QD.
Exhibits W & X: Brochures including a PBC-6-2L (LO) crate for 2-liter bottles.
Exhibit Y: Brochure and photo, “Interlocking bottom grid. Cross stackable”.
Exhibit Z: One-page brochure disclosing a prior art 2-liter PET case having a plurality of notches on the top wall.
Exhibit AA: One-page brochure illustrating a prior art 2-liter PET case.

* cited by examiner

STACKABLE LOW DEPTH BOTTLE CASE

CROSS-REFERENCE TO RELATED APPLICATIONS

This application is a continuation of Ser. No. 08/854,294 filed May 12, 1997, now abandoned, which is a continuation of Ser. No. 08/480,927, filed Jun. 7, 1995, now abandoned, which is a continuation-in-part of U.S. application Ser. No. 08/421,941, filed Apr. 13, 1995 now Pat. No. 5,651,461; which is a continuation in part of 1) U.S. application Ser. No. 08/384,331, filed Feb. 1, 1995, now Pat. No. 5,660,279, which is a continuation-in-part of U.S. application Ser. No. 07/919,376, filed Jul. 29, 1992, now Pat. No. 5,529,176 and is a cip of U.S. application Ser. No. 08/268,997, filed Jun. 30, 1994, now Pat. No. 5,465,843 which is a continuation-in-part of U.S. application Ser. No. 29/018,317, filed Feb. 3, 1994, now U.S. Pat. No. D361,431, the entire contents of each hereby being incorporated by reference.

TECHNICAL FIELD

The present invention relates to low depth stackable bottle cases for use in retaining and transporting bottles. More particularly, the present invention relates to beverage bottle cases that combine low depth with high stability for stored bottles, full label visibility for display purposes, and an integrally formed logo for easy identification of the bottle or product supplier.

BACKGROUND OF THE INVENTION

Plastic bottles are widely used as containers for retailing soft drinks and other beverages. One type of plastic, polyethylene terephthalate (PET), has become particularly popular because of its transparency, light weight, and low cost. In addition to being flexible, the walls of PET bottles are strong in tension and thus can safely contain the pressure of a carbonated beverage. Moreover, conventional PET bottles can bear surprisingly high compressive loads, provided that the load is directed substantially along an axially symmetric axis of the bottle. A single PET bottle can support the weight of many bottles of the same size filled with beverage if the bottle is standing upright on a flat, horizontal surface and the weight of the other bottles is applied to the closure of the single bottle and is directed substantially vertically along the symmetric axis. However, if a compressive load is applied to a conventional PET beverage bottle along a direction other than the symmetry axis of the bottle, the bottle tends to buckle. This tendency of conventional PET bottles to give way under off-axis compressive loads is particularly pronounced for large capacity bottles, such as the two-liter bottle widely used for marketing soft drinks.

Soft drink bottles are ordinarily packaged by bottlers in cases or other containers, several bottles to the case, for shipment to retailers or for storage. The term "case", "crate" or "tray" is used interchangeably herein to include all cases, crates, trays and similar containers having a bottom and peripheral side wall structure. Cases of bottles are customarily stacked on top of each other. In storage warehouses, columns of cases are frequently stacked on pallets which can be lifted and moved about by fork-lift trucks. The stacks of cases on the pallets must therefore be particularly stable in order to remain standing in the face of the jostling inherent in being moved about. A technique for interconnecting stacks of empty cases, called "cross-stacking," is often used to improve the stability of empty cases loaded on a warehouse pallet. Cross-stacking generally involves stacking rectangular bottle cases to build up a layered structure, with each layer having cases oriented parallel to each other and with the adjacent layers being oriented at right angles to each other. Thus, since the adjacent layers are perpendicular, each case in the cross-stacked layer rests on at least two cases in the layer below. As a result, the cases of the cross-stacked layer tend to keep the cases on which they rest from moving apart from each other. The cross-stacked layers therefore stabilize the stacked structure.

Because of the tendency of conventional PET beverage bottles to buckle under off-axis loads, attempts to stack cases of these bottles give rise to serious problems. Bottles can tilt away from vertical alignment upon stacking if conventional partitioned cases having low side walls are used to contain the bottles. Tilted bottles in the lower cases of a stack can buckle and give way, causing the stack to fall. Even absent buckling, the tendency of bottles to tilt in conventional low-sided cases causes problems. Tilting generally places an undesirably low limit on the number of tiers in a stack since the tilting of bottles in one case can cause the next higher case in the stack to tilt. This leads to instability if too many tiers are included in the stack.

Previously, these problems were dealt with by packaging beverage bottles in corrugated-paper cartons having high sides, often equal in height to the height of the bottles. Two-liter PET bottles filled with soft drinks were often packaged in enclosed corrugated paper cartons for storage and shipment. Although the high sides of these paper cartons reduce the incidence of tilting and provide additional support when the cartons are stacked, the cartons are expensive. The cost of the cartons cannot ordinarily be distributed over a number of repeated uses since corrugated-paper cartons generally are not rugged enough for reuse and therefore they are usually discarded by the retailer. The cartons also do not generally provide viewing of the products there within and, thus, even the cartons loaded with bottles are not easily identifiable with a particular soft drink bottler.

One solution to the problems of full depth corrugated-paper cartons is plastic full depth cases; that is, plastic cases having peripheral sidewalls approximately the same height as the bottles. In plastic full depth cases, the sidewalls are the load bearing surfaces. Full depth plastic cases, however, have numerous disadvantages. They are expensive to manufacture, they are expensive to ship and to store empty in a warehouse as they require a large amount of space. Full depth cases also totally surround the bottles and prevent display of the bottles and are not easily identifiable with a particular product or supplier, except by the imprinted or painted logos or other insignia that may be applied thereto.

To overcome these problems plastic low depth cases have been used. A low depth case is one in which the side walls are lower than the height of the stored bottles, and in which the bottles support the weight of additional cases stacked on top. The commonly assigned U.S. Pat. Nos. 4,899,874 and 4,978,002, the contents of which are hereby incorporated by reference, disclose a low depth bottle case for two-liter bottles that is cross-stackable when empty if the upper cross-stacked cases are properly positioned. In addition, in the embodiment disclosed the substantially flat upper surface across the bottle retaining pockets permits one piece petaloid bottles and bottles with base indentations to be retained. The low height of the case sidewalls and the columns above the case sidewalls also allow the display of the bottle labels to the consumer. The side walls, however, are generally rectangular and do not identify the particular supplier of the soft drink, except by imprinted or painted logos or insignias that may be provided.

SUMMARY OF THE INVENTION

These and other problems of the prior art are overcome by the stackable low depth case of the present invention. The stackable low depth case for retaining and transporting bottles has opposing side walls and opposing end walls that form an outer shell having a case bottom disposed substantially within the outer shell. The side walls include a lower wall portion and a plurality of spaced upwardly projecting pylons, four corner pylons defining four corners of the case. A plurality of spaced upwardly projecting columns generally disposed within the outer shell define, in combination with the case bottom, the side walls and the end walls, a plurality of bottle retaining pockets. The columns and the pylons extend above the lower wall portions and below a top surface of the retained bottles. At least one of the walls includes an integrally molded logo which identifies the source of the goods.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF THE PREFERRED EMBODIMENTS

Figure 1:
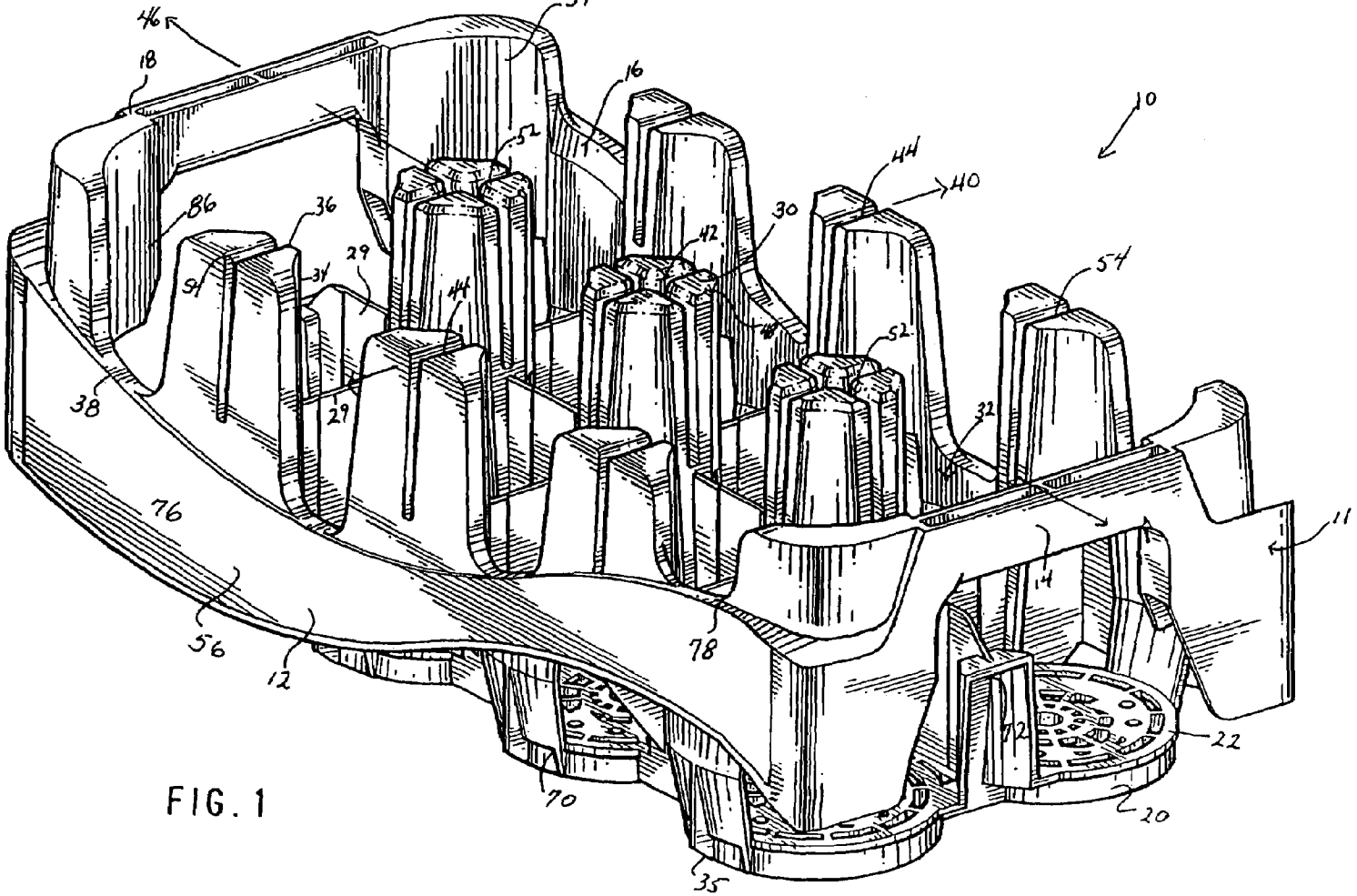
FIG. 1 is a top perspective view of a stackable low depth case according to the present invention.

As shown in FIGS. 1–6, the stackable low depth bottle case 10 has two basic elements: a floor structure 20 and a wall structure 11. Wall structure 11 includes four side walls 12, 14, 16, 18. Side walls 12, 16 are relatively long and extend the length of case 10 whereas side walls or end walls 14, 18 are relatively short and extend the width of case 10. As discussed further below, side walls 12 and 16 define a logo or insignia to identify the supplier of the bottled product or the case itself. The depth or height of side walls 12, 14, 16, 18 is relatively low compared to the height of the bottles retained therein. The ratio of the length of long side walls 12, 16 to the length of short end walls 14, 18 is substantially equal to the ratio of the number of bottles the case holds in the lengthwise direction to the number of bottles the case holds in the widthwise direction. For example, an 8-bottle case is approximately twice as long as it is wide and holds bottles in a 4×2 relationship. This length to width relationship will be discussed further below.

Figure 2:
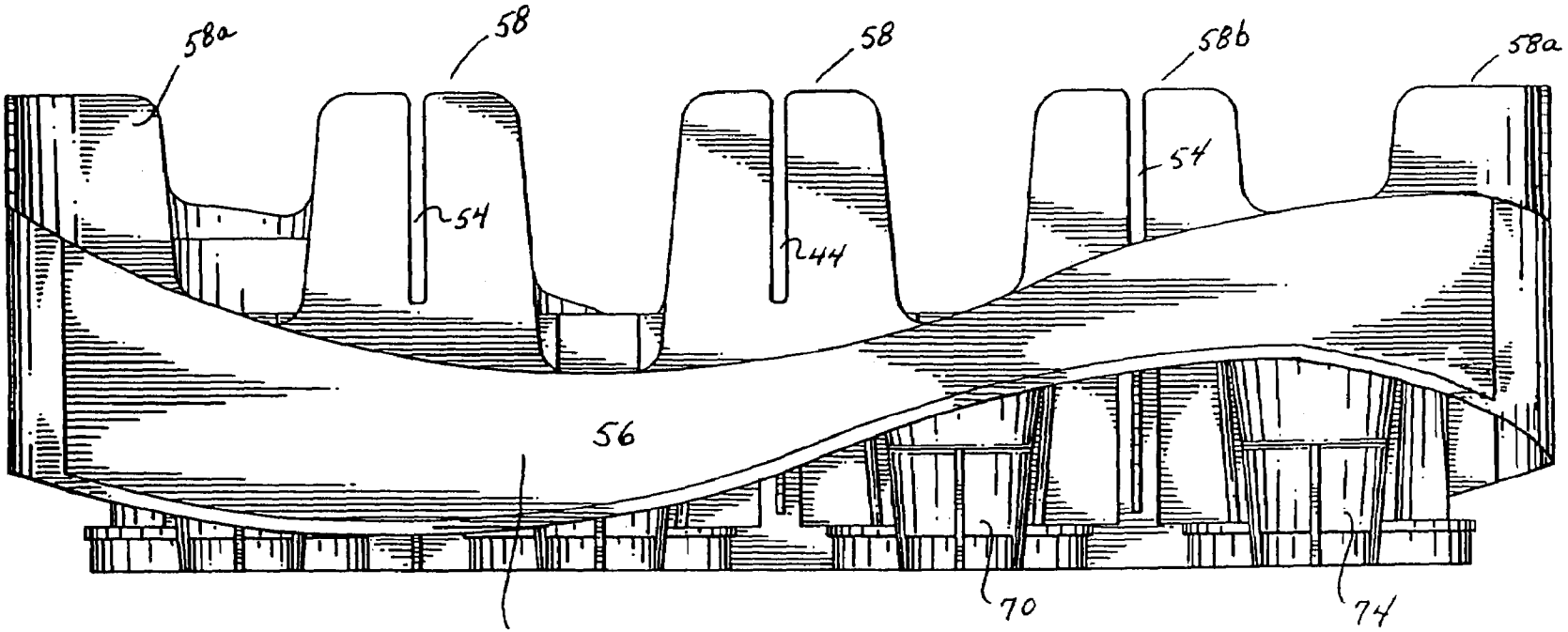
FIG. 2 is a side elevational view thereof.
Figure 3:
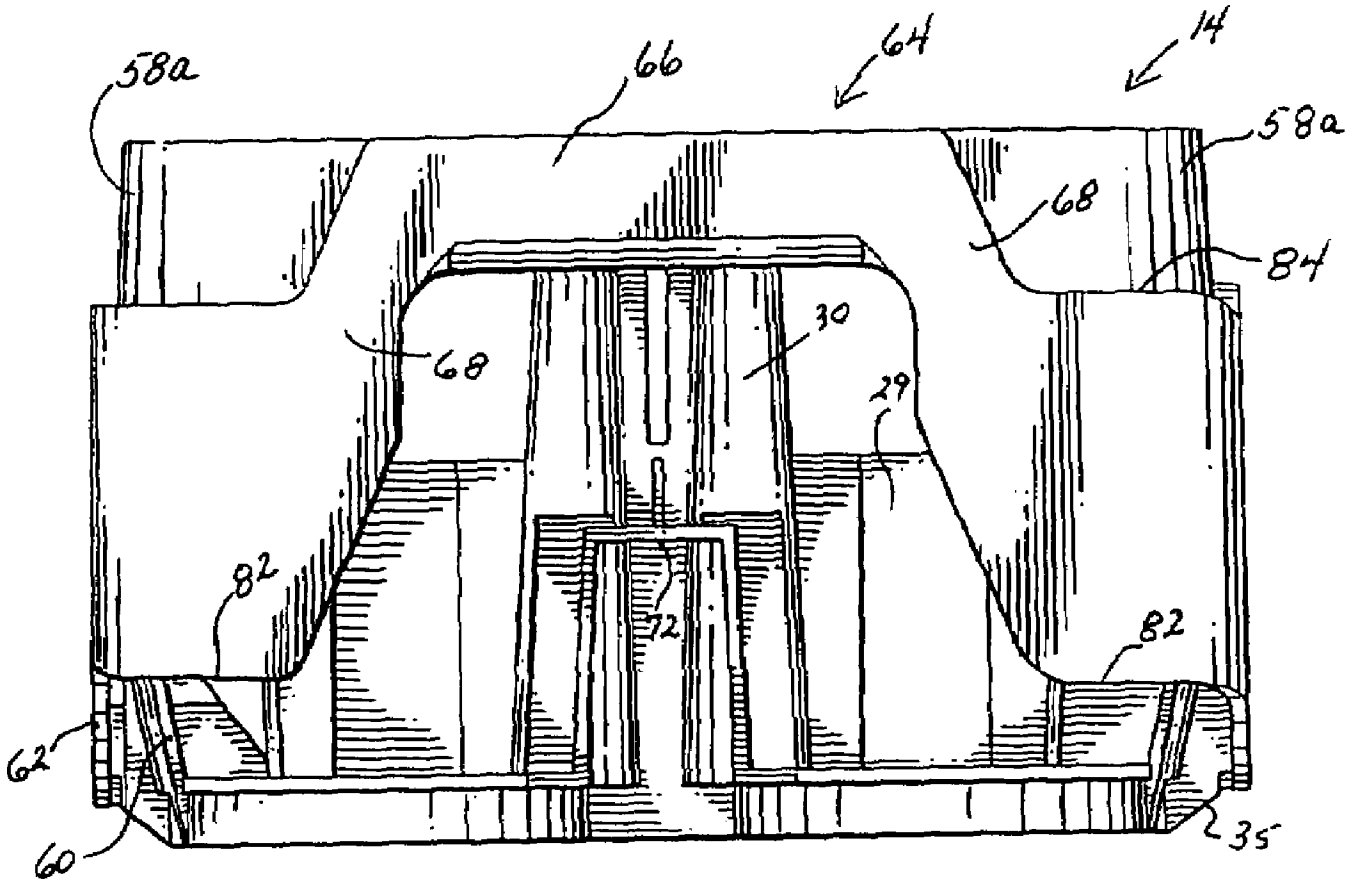
FIG. 3 is an end elevational view thereof.
Figure 4:
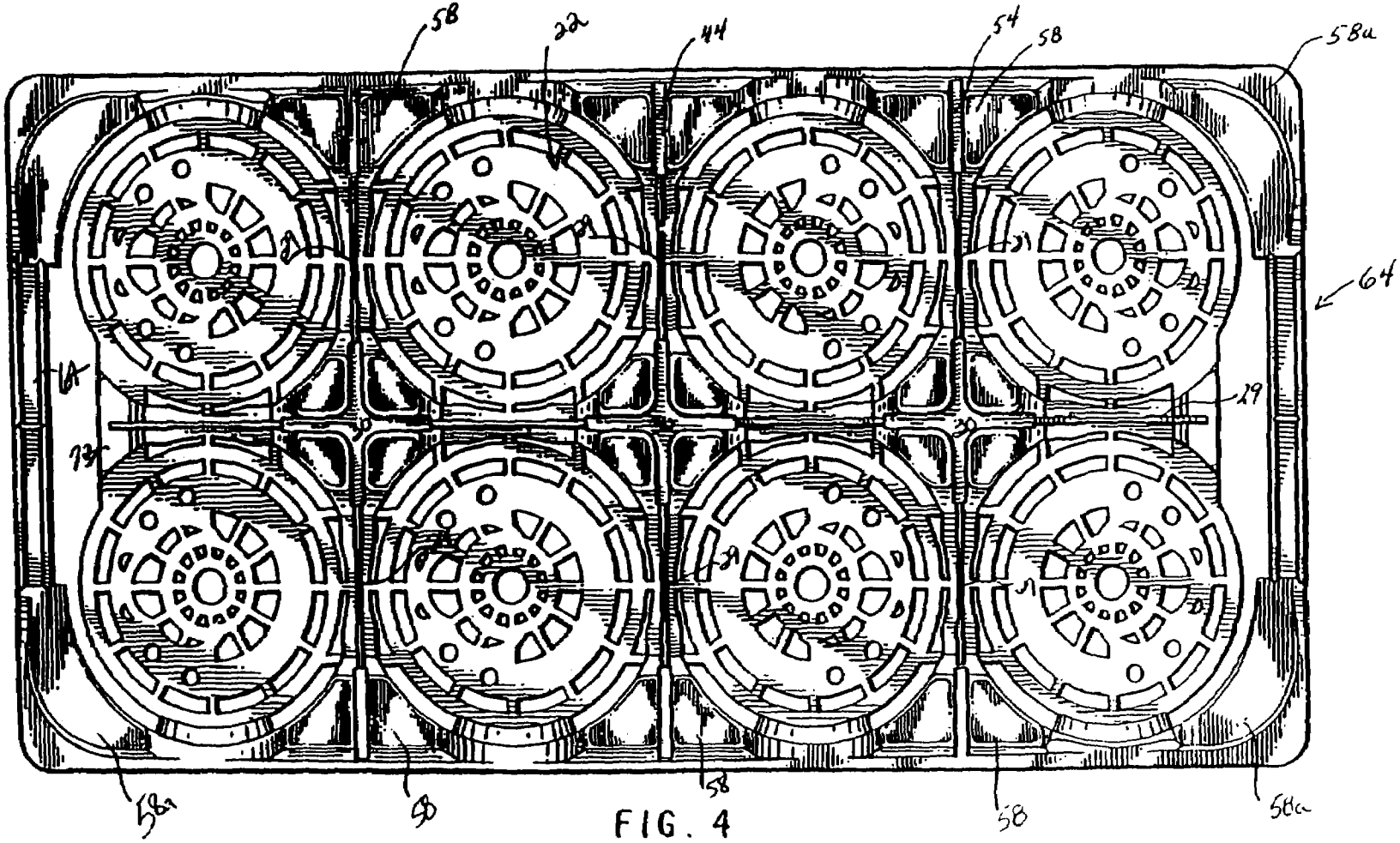
FIG. 4 is a top plan view thereof.
Figure 5:
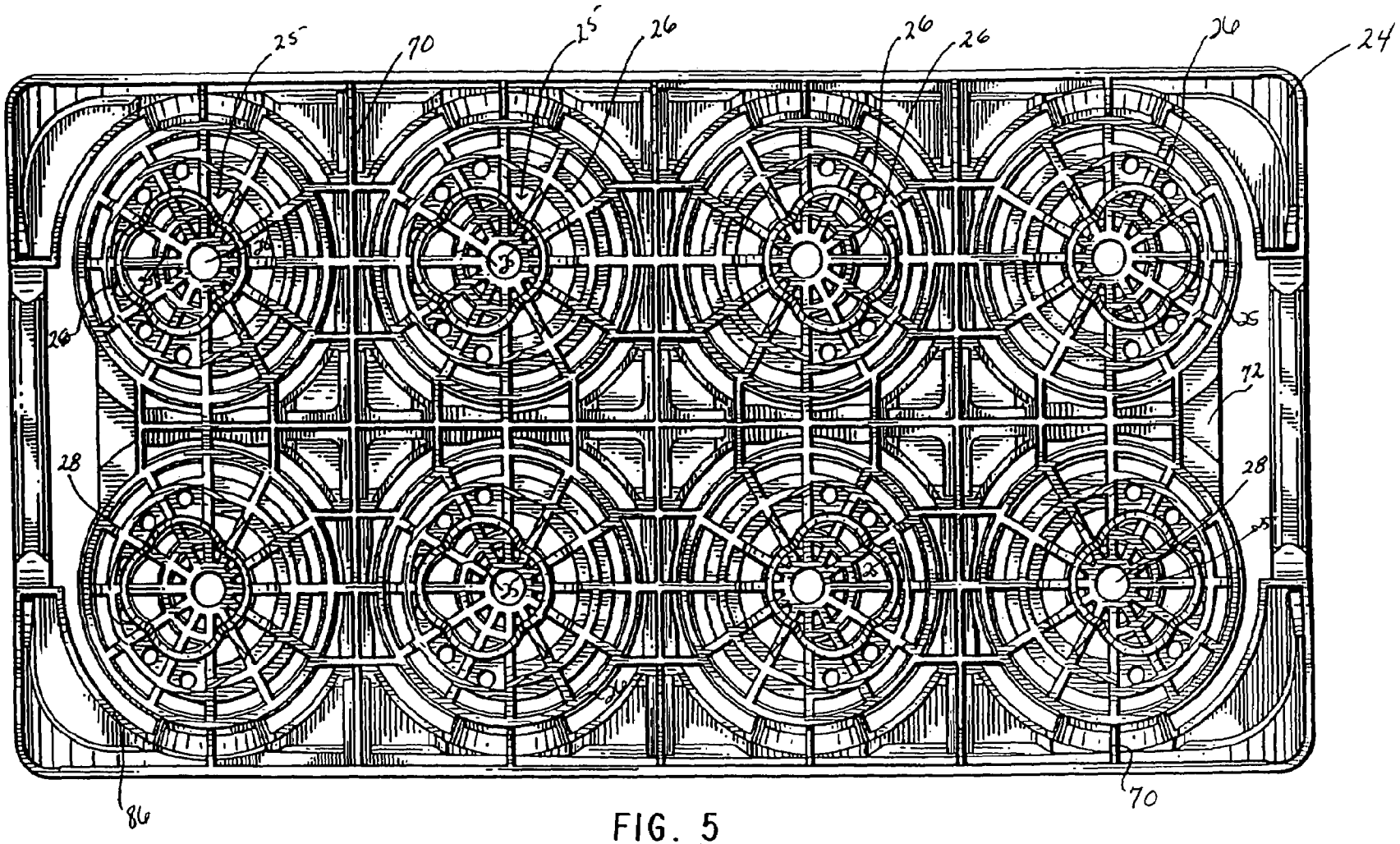
FIG. 5 is a bottom plan view thereof.

As best shown in FIG. 1–3, case 10 also includes a floor structure or bottom portion 20 attached to side walls 12, 14, 16, 18 to form the outer shell of case 10. Preferably, case 10 is made from plastic and is molded integrally as a single component. Bottom portion 20 has an upper surface 22 and a lower surface 24. Upper surface 22 is substantially flat in order to accommodate a variety of bottles, including one piece petaloid bottles and two piece base cup bottles. Lower surface 24 is formed as a plurality of closure acceptance areas 25 defined by generally concave concentric circular portions 26, each having a central retaining opening 28 disposed therein as shown in FIG. 5. The number of closure acceptance areas corresponds to the number of bottles the case is designed to retain. In addition, the periphery of bottom portion is finished with a beveled edge 35 to facilitate handling by allowing hand trucks to slide easily under the case.

Figure 6:
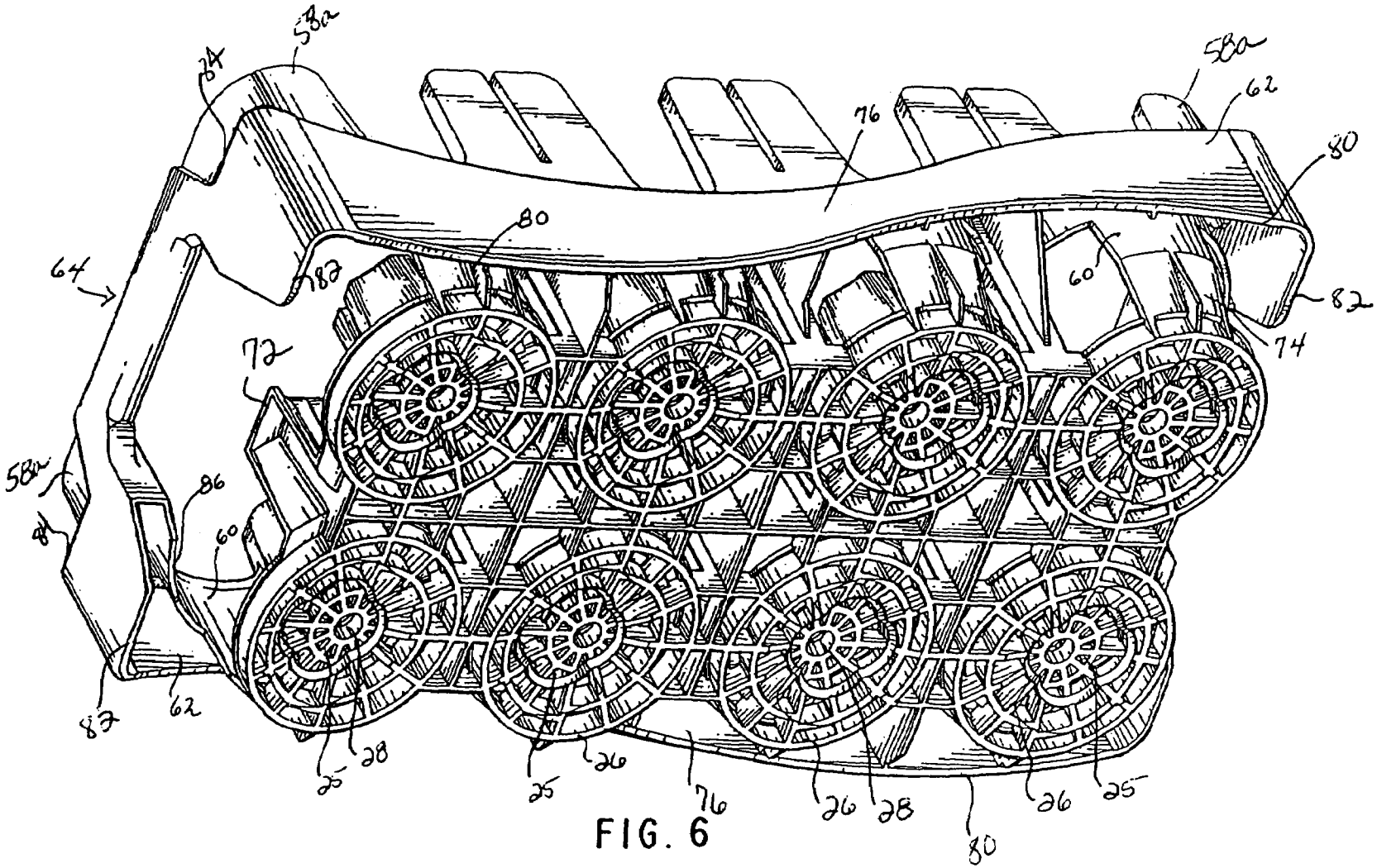
FIG. 6 is a bottom perspective view thereof.

The closure acceptance areas 25 of lower surface 24, shown clearly in FIGS. 5 and 6, allow cases 10 filled with bottles to be vertically stacked for transportation, storage, and display purposes. Circular concave portions 26 are formed offset from the centerline of the retained bottles by ribs or projections which define the circular concave shape. These ribs also form central retaining opening 28. Central retaining opening 28 is sized to receive the bottle top of a bottle which is disposed in a lower case 10. The bottle top fits adjacent central retaining opening 28 so that central retaining opening 28 retains the bottle top in position against lower surface 24. The conical shape of circular concave portion 26 assists the bottle top to abut central retaining opening 28. When an upper case 10 is being positioned on loaded lower case 10, often bottle tops will not precisely line up with respective central retaining openings 28. However, the bottle tops will contact the offset circular concave portions 26 and, because of the concave shape, be guided into central retaining openings 28. In the preferred embodiment of the invention, as illustrated, a cloverleaf closure acceptance area 25 is utilized to ensure that there is contact around the entire perimeter of the closure acceptance area. The cloverleaf closure acceptance area 25 substantially restrains the end-to-end movement as well as the side-to-side movement of the bottles in the stacked cases. Thus, even though the center-to-center distances between adjacent bottle retaining pockets are not substantially equal between adjacent cases, the use of offset concentric circles and a cloverleaf shaped closure acceptance area enables the cases to be column stacked or cross-stacked in a stable pallet load.

Side walls 12, 16 each include a lower wall portion 56 and a plurality of pylons 58. It will be understood in the present invention that "pylon" denotes an upwardly extending hollow column or post. In addition to the side wall pylons 58, a corner pylon 58*a* is disposed in each corner of case 10. Pylons 58, 58*a* are integrally formed with lower wall portion 56 and floor structure 20. Pylons 58, 58*a* are preferably hollow and generally extend upward from and beyond a top edge of lower wall portion 56. Pylons 58, 58*a* are integral with the interior and exterior lower wall portion 60, 62. Interior lower wall portion 60 and exterior lower wall portion 62 combine to provide a double-walled construction to case 10 such that they are respectively contiguous with the interior and exterior surfaces of the side and corner pylons. This construction ensures that case 10 will have sufficient strength and rigidity for a variety of handling situations.

In a preferred embodiment, the interior lower wall portion 60 of sidewalls 12, 16 is defined by a plurality of retaining tabs 74 extending upwards from bottom portion 20. The exterior lower wall portion 62 of side walls 12, 16 is defined by an integrally formed logo 76 or insignia which identifies the company. The company may be the bottler, the product within the bottle, the manufacturer of case 10 or any other company having an interest in being identified with the bottle case, the bottles or the product. "Logo" as used herein should be broadly interpreted to mean any geometric pattern, alphanumeric or written pattern, symbol, emblem, design, trademark or other identifier of the company or source of the goods, such as industry symbols, company mascots, company names, and the like. The integral logo 76 as defined herein forms a structural component of the bottle case having an upper logo edge 78 and a lower logo edge 80, as differentiated from a logo which is merely embossed or molded onto a wall of the bottle case. The interior and exterior lower wall portions may both be used to define the integral logo, or just the exterior.

In a preferred embodiment, the lower edges 82 of end walls 14, 18 on opposing sides of handle portion 64 are at approximately the same height relative to bottom portion 20. As a result, the lower edge 80 of logo 76 adjacent end wall 14 is also at approximately the same height as lower edge 80 of logo 76 adjacent end wall 18. This symmetric lower edge configuration assists in the utilization of case 10 of the present invention with automated machinery such as case palletization equipment. Similarly, although not related to this purpose, it is also preferred for the illustrated embodiment that the upper edges 84 of end walls 14, 18 on opposing sides of handle portion 64 be at approximately the same height, and that as a result the upper edge 78 of logo 76 adjacent end wall 14 is also at approximately the same height as upper edge 78 of logo 76 adjacent end wall 18.

A plurality of vertical walls 29 and columns 30 are disposed within side walls 12, 14, 16, 18. For clarity of the present invention, "columns" denote an upwardly extending hollow column or post within the interior area of the case and "pylon" denotes the same around the periphery of the case. In a preferred embodiment, vertical walls 29 extend to the top surface of bottom portion 20. The side edges of vertical walls 29 abut pylons 58 and columns 30 and help to secure the interior surfaces of pylons 58 and columns 30 to bottom portion 20. Vertical walls 29, columns 30, and pylons 58, 58*a*, when combined with upper surface 22 of bottom portion 20 and sidewalls 12, 14, 16, 18, (including retaining tabs 74) define a plurality of bottle retaining pockets 32. Columns 30 and pylons 58, 58*a* extend above bottom portion 20 a distance approximately equal to forty percent of the height of the bottles to be retained in case 10. For example, where cases 10 are shaped to retain lightweight 2-liter bottles, columns 30 and pylons 58, 58*a* define a case that is approximately 5.25 inches tall. This increases the effective height of the case while maintaining high bottle visibility and low manufacturing costs. In addition, since the columns and pylons increase the lateral stability of the bottle within bottle retaining pocket 32, a greater variance in the diameters of the bottles is obtained because as snug of fit is no longer necessary, as in the prior art cases.

Pylons 58 are disposed along the walls 12, 16 and columns 30 are disposed away from the walls, centrally within bottom portion 20. Pylons 58*a* disposed in the corners between two adjacent walls have one curved surface 34. Pylons 58 disposed on sidewalls 12, 16 have two curved surfaces 34 and one flat surface 36 disposed therebetween. The two curved surfaces 34 help define two separate and adjacent bottle retaining pockets 32. Flat surface 36 is disposed between these two bottle retaining pockets. Columns 30 that are disposed centrally within bottle portion 20 are octagonally shaped. These columns 30 have four alternating curved surfaces 34 and four alternating flat surfaces 36. The four curved surfaces 34 define portions of four bottle retaining pockets 32 and the four flat surfaces 34 separate these pockets. Four curved surfaces 34 on four separate columns 30 or pylons 58 form the four corners of interior bottle retaining pocket 32. Exterior bottle retaining pockets formed by corner pylons 58*a*, side pylons 58, and columns 30 are defined by only three corners since there are no side pylons on end walls 14, 18, the reasons for which are discussed below.

As shown in FIG. 1, column 30 and pylons 58 disposed along a center line 40 of the length of the case 10 (along the transverse axis of case 10) include recesses 42, 44, respectively, which for the disclosed embodiments extend downwardly to a height which substantially equals the height of vertical walls 29. Columns 30 disposed along a center line 46 of the width of the case (along the longitudinal axis of case 10) also include recesses 48 which extend downwardly to a height substantially equal to the height of vertical walls 29. Further, columns 30 and pylons 58 disposed along an axis parallel to center line 40 along the transverse axis of the case include recesses 52, 54, respectively. Depending upon the particular logo of the sidewalls 12, 16, the recesses 44, 54 in pylons 58 may not all be equal. In the disclosed embodiment, for example, pylon 58(*b*) is disposed above the higher side of lower wall 56 and is therefore shorter than adjacent pylons 58. The recess in pylon 58(*b*) is therefore also shorter than the recesses in the adjacent pylons. As discussed below, these recesses are for receiving ribs of an identical upper case and provide flexibility in the stacking of identical cases.

The upper surface 22 of bottom portion 20 within bottle retaining pockets 32 is substantially flat. This permits retention of bottles regardless of the configuration of the bottom of the bottles. Also, this allows petaloid bottles to be rotated within the bottle retaining pockets to facilitate display of the product. The low depth feature of case 10 as well as the windows or depressions 38 cut out from side walls 12, 16 further enhance display of the product labels in a retail setting.

In prior art cases, the center-to-center distances between adjacent bottle retaining pockets has generally been equal. Thus, the symmetrical and conical shape of the circular portions aligned the bottle tops with the central retaining openings, regardless of whether the cases were column stacked or cross-stacked. In the present invention, however, the positioning of handle portions 64 disrupts the equality of center-to-center distances between adjacent end bottle retaining pockets in adjacent cases with abutting side walls.

Bottom portion 20 also includes a plurality of ribs 70 corresponding in location to recesses 42, 44, 48, 52, 54 within columns 30 and pylons 58 and extending upwards from lower surface 24 to the bottom of the recesses. The correspondence between the ribs and the column and pylon recesses enables case 10 to be column nested one on top of another, as described in detail in parent application U.S. Ser. No. 08/421,941. This is also accomplished by having pylons 58, 58*a* and columns 30 which are angled toward the interior of the case. This means that pylons 58, 58*a* and columns 30 are tapered so that the cross sections at their tops are smaller than their cross sections nearer the lower wall portion. Pylons 58, 58*a* are also set slightly inward from the height of lower wall portions 56 to further enhance the nestability of empty cases. When case 10 of the present invention is nested, the interior surface 86 of corner pylons 58*a*, as best shown in FIG. 6, rests upon the upper surface of the corner pylon therebeneath in the identical lower case. In the illustrated embodiment, the lower edge 80 of integral logo 76 of an upper nested case will be spaced slightly above the upper edge of the integral logo of the identical lower case.

End walls 14, 18 are formed by handle portions 64 to facilitate carrying case 10. Preferably for 2 liter cases, the upper surfaces of handle portions 64 are equal in height to corner pylons 58*a*, which are equal in height to pylons 58 and columns 30. Handles 64 extend integrally from corner pylons 58*a*, and comprise substantially horizontal handle bars 66 integral with handle supports 68 which extend angularly inward from the corner pylons. Handle supports 68 of each handle 64 diverge from handle bar 66 such that the handle has a generally trapezoidal configuration with the handle bar defining the short side of a trapezoid and the supports defining the diverging legs.

Handle portions 64 can be utilized to lift case 10 in the usual manner by grasping the upper edge with the palm facing upwards and the fingers curling upwards and into the case. This manner of lifting is damaging to the wrists, however, when delivery personnel are lifting a case from above their head. Therefore, the present invention also allows handle portions 64 to be gripped with the palm facing down and the fingers curling downwards around handle bar 66. There are no pylons or vertical walls on end walls 14, 18 in the area immediately interior to handle bar 66 in order to assure that there is adequate space for the fingers to be inserted and curled therearound. As most clearly shown in FIGS. 1 and 6, the upwardly extending end wall member 72 is terminated below the height of vertical walls 29 in order to not interfere with the handle performance yet still restrain the movement of the loaded bottles. In a further embodiment of the invention, handle portions 64 may also have finger recesses along the upper edge and/or lower edge to further aid in carrying case 10. Still further, handle portions 64 or an alternate handle configuration may be provided on side walls 12 and 16 in addition to end walls 14 and 18 such that a gripping structure is disposed on each side of the case.

Although described in detail with respect to the preferred embodiment having a plurality of columns and pylons, it should be clear to one skilled in the art that the integral logo 76 of the present invention can be used in any type of case or tray for transporting containers. It also not necessary for the integral logo 76 to be disposed in the lower wall portion of the case since it could easily be configured for placement anywhere within the wall structure of the case. That is, the logo could be formed along a top band or rim of a case when the side walls of the case are defined only by downwardly extending columns with large spaces therebetween, such as the cases illustrated in U.S. Pat. No. 5,267,649 or other similar designs.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

What is claimed is:

1. A stackable low depth case for retaining and transporting bottles, the case comprising opposing side walls and opposing end walls forming an outer shell, a case bottom disposed substantially within said outer shell, the case comprising:

each of said side walls including a lower wall and a plurality of spaced upwardly projecting pylons, four corner pylons defining four corners of the case wherein the lower wall includes an upper edge and a lower edge, the upper edge having a curved shape substantially along the length thereof and the lower edge having a curved shape substantially along the length thereof, wherein the entire upper edge is spaced below the uppermost surface of the pylons; and a plurality of spaced upwardly projecting columns generally disposed within the outer shell defining, in combination with the case bottom, said side walls, and said end walls, a plurality of bottle retaining pockets, said columns and said pylons extending above the lower wall and below a top surface of the retained bottles.

2. The stackable case of claim 1 wherein the upper and lower edges of the lower wall substantially define an exterior surface of said lower wall.

3. The stackable case of claim 2 wherein said lower wall further includes a plurality of retaining tabs substantially defining an interior surface of said lower wall and extending upwards from said case bottom.

4. The case of claim 1 wherein a space between each adjacent pair of pylons along the side walls opens upwardly completely from the upper edge of the lower wall to a plane defined by uppermost surfaces of the adjacent pair of pylons to provide visibility of containers in the case.

5. The case of claim 1 wherein the side walls are longer than the end walls.

6. A stackable low depth bottle case comprising:

a floor structure having an upper surface;

a pair of side structural members and a pair of end walls attached to the floor structure and defining an inner compartment with the floor structure, the side structural members having a lower edge and an upper edge, wherein the side structural members are longer than the end walls;

a plurality of pylons extending inwardly from the side structural members into the inner compartment, and a plurality of corner pylons defining corners of the case and extending into the inner compartment; and a plurality of longitudinally-spaced upwardly projecting columns generally disposed within the inner compartment defining, in combination with the floor structure and the side structural members, a plurality of bottle retaining pockets, each of the columns including at least one vertical, longitudinal recess opening upwardly and aligned with one another, each of the columns including a plurality of exterior surfaces each having an uppermost edge, each exterior surface partially defining one of the plurality of bottle retaining pockets, the uppermost edge of one of the exterior surfaces of one of the columns extending a first height above a first location along the upper edge of one of the pair of side structural members, wherein the first location is disposed between a pair of adjacent pylons, and the uppermost edge of one of the exterior surface of another of the columns extending a second height above a second location along the upper edge, wherein the second height is greater than the first height, wherein the second location is disposed between another pair of adjacent pylons, wherein at least one of the plurality of columns is located at the intersection of the case longitudinal axis and transverse axis and the uppermost edge of the exterior surface of the at least one of the plurality of columns is substantially coplanar with an uppermost edge of an exterior surface of of one of the plurality of pylons, the exterior surface of the one of the plurality of pylon partially defining one of the plurality of bottle retaining pockets.

7. The case of claim 6, wherein each of the pair of side structural members is contoured along its length.

8. The case of claim 6, wherein the upper edge of each of the pair of side structural members is contoured along its respective length.

9. The case of claim 6, wherein the lower edge of each side structural member is wave-shaped along its respective length.

10. The case of claim 6, wherein the side structural members are attached to the floor structure by a plurality of retaining tabs which define an interior surface of the inner compartment between adjacent pylon.

11. The case of claim 6, wherein the plurality of columns are substantially the same height.

12. The case of claim 6, further comprising a pair of integrally molded handle structures directly connecting a pair of corner pylons and having an exterior surface and a generally open area being defined below the exterior surface.

13. The case of claim 6, wherein the floor structure has a substantially flat upper surface.

14. The case of claim 6, wherein the floor structure has a lower surface which includes plurality of bottle closure acceptance areas defined by generally conically shaped, concave portions.

15. The case of claim 6, wherein the floor structure includes resting and guiding means for resting the floor structure on the closures of bottles on which the case is stacked, the resting and guiding means including a rib formation having a longitudinal centerline offset from the centerline of the bottle retaining pockets to guide closures of bottles into a central region of the bottle retaining pockets.

16. The case of claim 15, wherein the rib formation comprises a cloverleaf shape.

17. The case of claim 6, wherein at least one of the columns has a vertically extending portion disposed below the lower edge of the side structural members.

18. The ease of claim 6, wherein at least one of the columns has a vertically extending portion which is substantially co-planar with the lower surface of the floor structure.

19. The ease of claim 6, wherein the plurality of pylons extend above the upper edge of the side structural members.

20. The case of claim 6, wherein the plurality of pylons have upper surfaces which are generally co-planar.

21. The case of claim 6, wherein the plurality of pylons and the plurality of columns have generally co-planar upper surfaces.

22. A low depth crate for storing and transporting bottles, the crate comprising:

a floor including a floor top surface having thereon a plurality of support areas for supporting an array of bottles;

a pair of side structural members and a pair of end walls attached to the floor and defining an inner compartment with the floor structure, the side structural members having a lower edge and an upper edge, wherein the side structural members are longer than the end walls;

a plurality of pylons extending inwardly from the side structural members into the inner compartment; and a plurality of spaced upwardly projecting columns generally disposed within the inner compartment defining, in combination with the floor structure and the side structural members, a plurality of bottle retaining pockets, wherein each of a pair of the columns is of substantially the same height, and extends to an uppermost surface that is a first height above a first location along the lower edge of one of the pair of side structural members, and wherein another one of the columns has an uppermost surface that is a second height above a second location along the lower edge, wherein the second height is different from the first height, wherein the uppermost surface of the another one of the columns is substantially co-planar with an uppermost surface of one of the plurality of pylons.

23. The crate of claim 22, wherein the side structural members are contoured along their respective lengths.

24. The crate of claim 22, wherein the upper edge of the one of the pair of side structural members is contoured along its respective length.

25. The crate of claim 22, wherein the lower edge of each side structural member is wave-shaped along its respective length.

26. The crate of claim 22, wherein the side structural members are attached to the floor structure by a plurality of retaining tabs which define an interior surface of the inner compartment between adjacent pylons.

27. The crate of claim 22, wherein the another one of the columns is located at the intersection of the case longitudinal axis and transverse axis.

28. The crate of claim 22, wherein the plurality of columns are substantially the same height.

29. The crate of claim 22, further comprising a plurality of corner pylons defining corners of the case and extending into the inner compartment.

30. The crate of claim 29, further comprising a pair of integrally molded handle structures extending between a pair of corner pylons and having an exterior surface and a generally open area being defined below the exterior surface.

31. The crate of claim 22, wherein the floor has a substantially flat upper surface.

32. The crate of claim 22, wherein the floor has a lower surface which includes plurality of bottle closure acceptance areas defined by generally conically shaped, concave portions.

33. The crate of claim 22, wherein at least one of the columns has a vertically extending portion disposed below the lower edge of the side structural members.

34. The crate of claim 22, wherein at least one of the columns has a vertically extending portion which is substantially co-planar with a lower surface of the floor.

35. The crate of claim 22, wherein the plurality of pylons extend above the upper edge of the side structural members.

36. The crate of claim 22, wherein the plurality of pylons have upper surfaces which are generally co-planar.

37. The crate of claim 22, wherein the plurality of pylons and the plurality of columns have generally co-planar upper surfaces.

38. The crate of claim 22, wherein at least some of pylons and at least some of the plurality of columns have generally co-planar upper surfaces.

39. A stackable low depth bottle case comprising:

a floor structure having an upper surface;

a pair of side structural members attached to the floor structure and defining an inner compartment with the floor structure, the side structural members having a lower edge and an upper edge;

a plurality of pylons extending inwardly from the side structural members into the inner compartment, and a plurality of corner pylons defining corners of the case and extending into the inner compartment; and a plurality of spaced upwardly projecting columns generally disposed within the inner compartment defining, in combination with the floor structure and the side structural members, a plurality of bottle retaining pockets, wherein a first column and second column each extend a first height above a predetermined first location along the upper edge of one of the pair of side structural members, wherein the predetermined first location is disposed between a pair of adjacent pylons, and wherein a third column is located at the intersection of the case longitudinal axis and transverse axis and extends a second height above a predetermined second location along the upper edge of the one of the pair of side structural members, wherein the second height is greater than the first height and wherein the second height to which the third columns extends is substantially co-planar with an uppermost surface of one of the plurality of pylons.

40. The case of claim 39, wherein the plurality of columns are substantially the same height.

41. The ease of claim 39, wherein the plurality of pylons extend above the upper edge of the side structural members.

42. The case of claim 39, wherein the plurality of pylons and the plurality of columns are generally co-planar.

43. The case of claim 42, wherein each of the upper and lower edges of the side structural members is wave-shaped along its length.

44. The case of claim 42 wherein the first location is different from the second location.

45. A low depth crate for storing and transporting bottles, the crate comprising:

a floor including a floor top surface having thereon a plurality of support areas for supporting an array of bottles;

a pair of side structural members and a pair of end walls attached to the floor and defining an inner compartment with the floor structure, at least one of the pair of side structural members having a lower edge and an upper edge;

a plurality of corner pylons defining corners of the case and extending into the inner compartment;

a plurality of pylons extending inwardly from the aide structural members into the inner compartment between each pair of corner pylons on each side structural member; and a plurality of spaced upwardly projecting columns generally disposed within the inner compartment defining, in combination with the floor structure and the side structural members, a plurality of bottle retaining pockets, wherein each of a pair of the columns is of substantially the same height, and extends to an uppermost surface that is a first height above a first location along the lower edge, and wherein another one of the columns has an uppermost surface that is a second height above a second location along the lower edge, wherein the second height is different from the first height, wherein the uppermost surface of the another one of the columns is substantially co-planar with an uppermost surface of one of the plurality of pylons.

46. A low depth crate for storing and transporting bottles, the crate comprising:

a floor including a floor top surface having thereon a plurality of support areas for supporting an array of bottles;

a pair of side structural members and a pair of end walls attached to the floor and defining an inner compartment with the floor structure, one of the side structural members having a lower edge and an upper edge, the end walls each including a handle;

a plurality of pylons extending inwardly from the side structural members into the inner compartment; and a plurality of spaced upwardly projecting columns generally disposed within the inner compartment defining, in combination with the floor structure and the side structural members, a plurality of bottle retaining pockets, wherein each of a pair of the columns is of substantially the same height, and extends to an uppermost surface that is a first height above a first location along the lower edge, and wherein another one of the columns has an uppermost surface that is a second height above a second location along the lower edge, wherein the second height is different from the first height, wherein the uppermost surface of the another one of the columns is substantially co-planar with an uppermost surface of one of the plurality of pylons.

47. A low depth crate for storing and transporting bottles, the crate comprising:

a bottom portion having a top surface having thereon a plurality of support areas for supporting an array of bottles;

at least one side structural member attached to the bottom member and defining an inner compartment with the bottom member, the at least one side structural member having a lower edge and an upper edge;

a plurality of corner pylons defining corners of the case and extending into the inner compartment;

a plurality of pylons extending inwardly from the side structural members into the inner compartment between each pair of corner pylons on each side of the at least one structural member; and a plurality of spaced upwardly projecting columns generally disposed within the inner compartment defining, in combination with the bottom member and the at least one side structural member, a plurality of bottle retaining pockets, wherein each of a pair of the columns is of substantially the same height and extends to an uppermost surface that is a first height above a first location along the lower edge, and wherein another one of the columns has an uppermost surface that is a second height above a second location along the lower edge, wherein the first height is different from the second height, and wherein the uppermost surface of the another one of the columns is generally co-planar with an uppermost surface of at least one of the plurality of pylons.

* * * * *

UNITED STATES PATENT AND TRADEMARK OFFICE

CERTIFICATE OF CORRECTION

PATENT NO. : 7,086,531 B2
APPLICATION NO. : 09/844822
DATED : August 8, 2006
INVENTOR(S) : Apps et al.

It is certified that error appears in the above-identified patent and that said Letters Patent is hereby corrected as shown below:

IN THE CLAIMS:

In Claim 43, Column 11, Line 16 of the issued patent, “claim 42” should read as --claim 39--.

In Claim 44, Column 11, Line 19 of the issued patent, “claim 42” should read as --claim 39--.

Signed and Sealed this

Twenty-eighth Day of November, 2006

JON W. DUDAS
*Director of the United States Patent and Trademark Office*